United States Patent [19]

Rodriguez Gazulla

[11] Patent Number: 4,606,480

[45] Date of Patent: Aug. 19, 1986

[54] LIQUID SPRAYER

[75] Inventor: Francisco Rodriguez Gazulla, Barcelona, Spain

[73] Assignee: Monturas Y Fornituras, S.A., Barcelona, Spain

[21] Appl. No.: 628,909

[22] Filed: Jul. 9, 1984

[30] Foreign Application Priority Data

Jul. 14, 1983 [ES] Spain ..... 273.524

[51] Int. Cl.[4] ..... B67D 5/42

[52] U.S. Cl. ..... 222/341; 222/383; 239/333

[58] Field of Search ..... 222/340, 341, 382, 383, 222/385, 309; 239/333

[56] References Cited

U.S. PATENT DOCUMENTS 1,178,269 4/1916 Schmidt ..... 222/341
3,061,202 10/1962 Tyler ..... 222/383
3,176,595 4/1965 Schwartz ..... 222/386
3,840,157 10/1974 Hellenkamp ..... 222/385
4,161,288 7/1979 McKinney ..... 222/385
4,225,060 9/1980 Kutik et al. ..... 222/340

FOREIGN PATENT DOCUMENTS 1272279 4/1972 United Kingdom ..... 222/383

*Primary Examiner*—H. Grant Skaggs
*Attorney, Agent, or Firm*—Staas & Halsey

[57] ABSTRACT

A liquid sprayer comprising a cylinder defining a pump chamber in which there is housed a piston capable of sliding between positions of minimum and maximum insertion respectively. The piston is hand operated by a trigger and is urged to the minimum insertion position by a spring and in the minimum insertion position, the cylinder free volume is at least 3.33 times larger than the free volume in the maximum insertion position of the piston in the cylinder.

14 Claims, 7 Drawing Figures

LIQUID SPRAYER

BACKGROUND OF THE INVENTION

1. Field of the Invention

This invention relates to a liquid sprayer of the type comprising: a body having therein a cylinder defining a pump chamber, a discharge conduit and a passage between said chamber and said conduit, with a port forming a valve seat on the conduit side of said passage; a stem housed in said discharge conduit having an end forming a valve body capable of sealingly engaging said port; a first spring urging said stem end in engagement with said port; a tubular piston extended by a dip tube and capable of sliding within said cylinder between a minimum insertion position and a maximum insertion position and having a check valve controlling the communication between the dip tube and the pump chamber; a second spring urging said piston to the minimum insertion position thereof in said cylinder; a rocking trigger adapted to cause the sliding movement of said piston; means for mounting said trigger to said body; and means for attachment to a liquid containing receptacle.

2. Description of the Prior Art

The known sprayers of this type have certain drawbacks. One of these drawbacks (occurring particularly when the pump chamber has large dead spaces, even when the piston is in the maximum insertion position thereof in the chamber and even when the spring urging the stem is very powerful) is that, on first use, namely, when the pump chamber is full of air only, several piston strokes are required to expel such air. A further drawback is that the first and/or last amount of liquid discharged each time the piston is operated is sprayed at a low pressure and therefore is reduced to dripping or a weak jet which does not hit the target, whereby, on the one hand liquid is wasted and, on the other, it may fall where not wanted.

Further drawbacks arise with the regular attachment systems for the sprayer body to the means for coupling to a receptacle. This means usually comprises a screw cap and in the usually known models the sprayer body is attached to the screw cap with a tight press fit between the screw cap and the sprayer body, causing material fatigue.

SUMMARY OF THE INVENTION

The object of the invention is to provide a sprayer of the above described type whereby the said drawbacks are overcome at the same time as the advantages of the known sprayers are maintained.

The first named drawbacks are overcome with a sprayer of the type described in which in the minimum insertion position of the piston in the cylinder, the free volume of the pump chamber and of the passage between said check valve and the valve formed by said stem and said port is at least 10/3 times larger than the free volume in the maximum insertion position of the piston in the cylinder.

With the above feature, in view of the low value of said dead spaces, a high pressure is reached in the pump chamber and which is required to overcome the force of said first spring. Consequently, when the pump chamber is full of air, a single piston stroke is practically sufficient to expel it.

Furthermore, when the pump chamber contains liquid to be sprayed, the latter is always discharged under great force since, if the pressure in the pumping chamber is insufficient, the first spring closes the passage between the discharge conduit and the pump chamber. Thus dripping or weak jets are avoided.

To attain the aforementioned volume ratio between the two end positions of the piston in the cylinder, according to the invention the piston is provided with a front surface which, in the maximum insertion position of the piston in the cylinder, engages the upper inner surface of the cylinder, said front surface being interrupted by the cavity of the tubular piston and by a longitudinal annular groove which is generally coaxial with the piston and adapted to contain the whole of the second spring in the maximum compression position thereof.

Furthermore, the position of the said check valve in the cavity of said piston is in an area close to the said front surface and preferably the portion of the side surface of the piston closest to the front surface thereof is of generally frustoconical shape, said frustoconical portion partly confronting said passage in the maximum insertion position of the piston in the cylinder.

Therefore, in the minimum insertion position of the piston, the pump chamber free volume is formed by that of the chamber itself (namely, the volume comprised between the front surface of the piston and the upper inner surface of the cylinder), plus the volume of the longitudinal annular slot, that of the piston cavity up to the check valve, that of the frustoconical gap between the piston and the cylinder and that of the passage up to the seal formed by the stem. Since these four last named volumes are relatively small and are the only ones remaining free in the maximum insertion position of the piston, the ratio between the maximum and minimum volumes is high.

According to a further feature of the invention, the piston is provided with an external transverse annular notch housing a sealing ring and the piston is formed from a hard plastics material, particularly, polyamide, polypropylene or an acetal resin.

Also according to the invention, the coupling means for the trigger to the body comprise a cylindrical shaft integrally attached to the trigger and a concave moulding integral with the body having the shape of a circular arc greater than a half-circle and having an internal radius generally equal to that of the said cylindrical shaft, thereby facilitating the assembly of both parts.

The lower part of the sprayer body opposite said cylinder is generally cylindrical and the means for the attachment thereof to the liquid containing receptacle comprises an internally threaded cap and according to the invention said cap is provided with an annular axially extending projection the outer side surface of which is generally juxtaposed to the inner surface of said lower part which is provided with a portion adjacent the edge thereof which is externally tapered from said edge, said lower part being provided with longitudinal slits to provide it with radial flexibility and wherein there is a cap sheath which laterally covers said cap and said lower part, said sheath having an upper orifice having a smaller diameter than said tapering section, said orifice being tapered also. This arrangement overcomes the abovementioned drawbacks concerning the attachment of the sprayer body to the cap without causing fatigue problems for the material.

To determine the relative transverse positions of the sheath and the cap, the invention contemplates that the inner surface of the sheath and/or the outer side surface of the cap should be provided with axially extending grooves and for the relative axial positioning of both parts, the cap sheath is provided, in the orifice thereof, with cap retaining means or the cap and the sheath welded together ultrasonically.

With reference to a communication between the interior of the vessel and the sprayer other than that provided by the dip tube, according to the invention the tubular piston is provided at the end thereof opposite to said cylinder with an external frustoconical surface, said cap being provided with an axially extending space adapted to guide the piston snugly, said space having a tapering surface adapted to receive the tapering portion of the piston snugly.

BRIEF DESCRIPTION OF THE DRAWINGS

To facilitate the understanding of the foregoing, reference is made hereinafter to the accompanying sheets of drawings which, in view of their explanatory nature, should be deemed to be devoid of any limitation on the scope of legal protection being applied for.

DETAILED DESCRIPTION OF THE PREFERRED EMBODIMENTS

Figure 1:
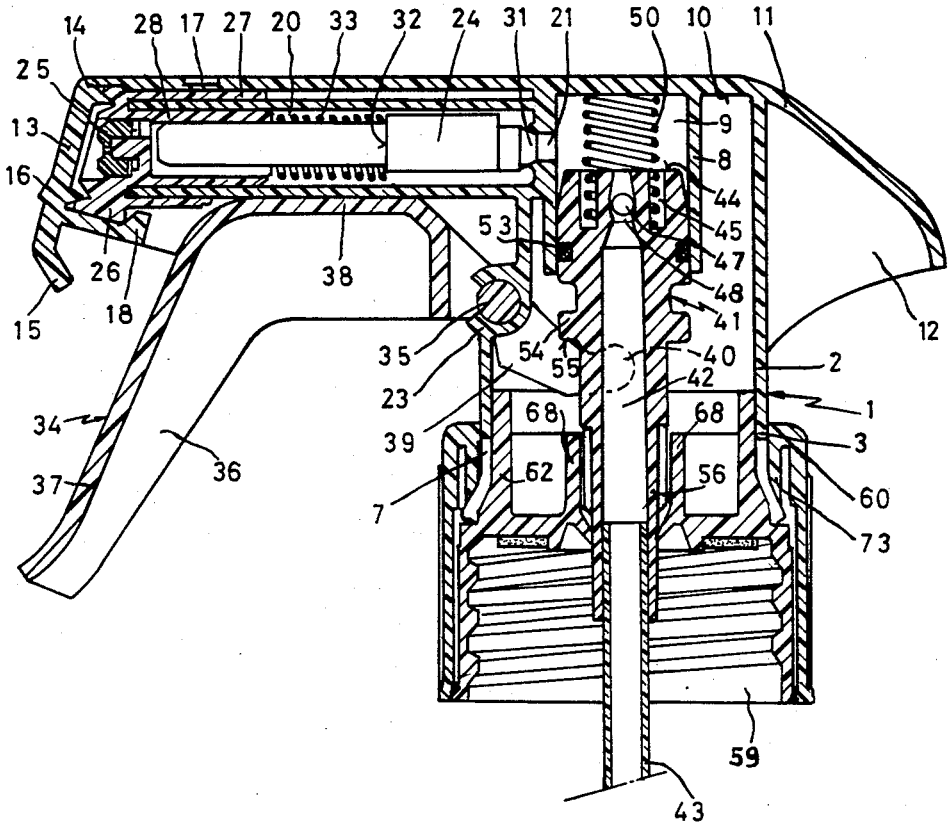
FIG. 1 is an axial cross section view of the liquid sprayer of the invention, showing the minimum insertion position of the piston in the cylinder, the cover being in the closed position.

The liquid sprayer according to the invention has a body 1 forming generally the framework of the sprayer, at the same time as it defines important parts thereof.

The axial portion of the body 1 is provided with an outer wall 2 the lower part 3 of which is generally cylindrical and is provided with a portion 4 (FIG. 5) adjacent the lower edge 5, the latter being preferably widened. Said portion 4 is provided with a frustoconical outer surface 6 which tapers out from the edge 5. Said lower part 3 is provided with a plurality of longitudinal slits 7 providing the lower portion with radial resilience suitable for mounting the sprayer, as will be described hereinafter.

In the interior there is a cylinder 8 defining a pump chamber 9 and an upper inner surface 10, which is a portion of the inner surface of a wall 11 having a skirt 12 extending therefrom.

The wall 11 is extended at the front end thereof with a cover 13 through a thin portion 14 which acts as a hinge and allows the cover to pivot, the cover being provided with a neb 15 allowing it to be seized. An external ridge 16 is adapted, when the cover is swung back, to snap into a cavity 17 of the wall 11, whereby the cover is held in a fixed open position. The neb 15 is provided with a lip 18 and an internal tapering shoulder 19 adapted to cooperate in a fixed closed position to be described.

In the transverse part of the body 1 there is a discharge conduit 20 which is surrounded on the top side thereof with the wall 11 and on the sides thereof with the skirts 12. Said conduit 20 communicates with the pump chamber 9 over a passage 21 which has at the conduit 20 end thereof a preferably circular port 22 forming a valve seat.

The body is also provided with a concave moulding 23 having the shape of an arc greater than a half-circle.

In the discharge conduit 20 there is a stem 24 the cross section of which is smaller than that of the conduit 20 and which is preferably three lobed. The sprayer is also provided with a nozzle 25 contained in a nozzle holder 26 provided with two coaxial cylindrical portions 27 and 28, one of which snugly surrounds the external surface of the conduit 20, contacting also the wall 11, while the other is fitted to the inner surface of said conduit. Said nozzle holder is provided with a lower protuberance 29 and a frustoconical groove 30 which respectively engage said lip 18 and frustoconical shoulder 19 to provide for the abovementioned fixed closed position.

Figure 6:
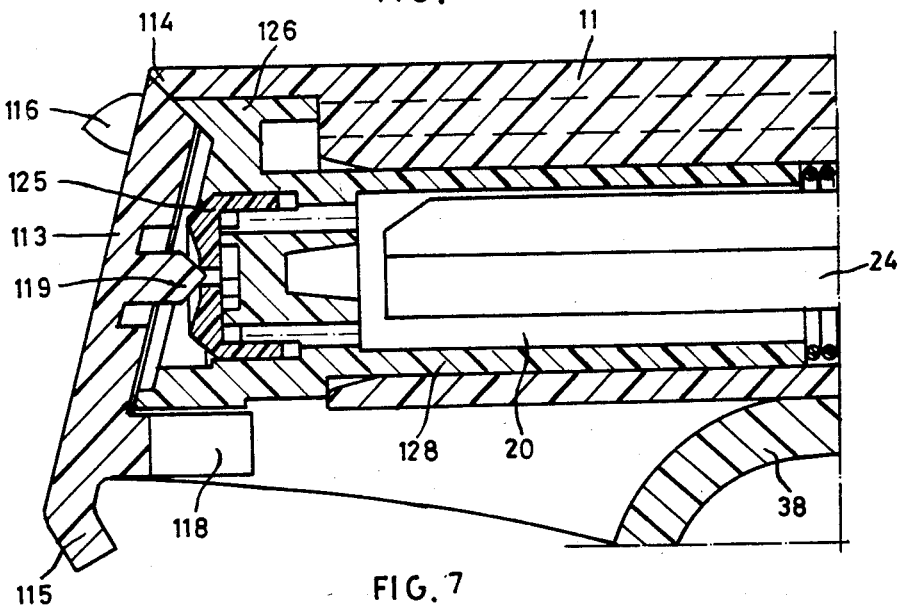
FIG. 6 is an axial cross section view, on a larger scale, of an alternative embodiment of the end of the discharge conduit and nozzle holder.

The end of the discharge conduit and the items associated therewith such as the nozzle holder, the nozzle and others may be embodied as illustrated in FIG. 6. This shows the discharge conduit 20 containing therein the stem 24 which is also three-lobed. The wall 11 is extended at the front end thereof with a cover 113 through a thinner portion 114 acting as a hinge and allowing the cover 113, which is provided with a neb 115 for holding purposes, to pivot. There are two external ridges 116 (only one of which is shown in the figure) adapted for cooperating in a fixed closed position, as indicated hereinafter. In the interior, the cover 113 has a stem 119 provided with a tapering end to seal the nozzle passage.

In the embodiment of FIG. 6, the nozzle 125 is contained in a nozzle holder 126 which, in this case, has a cylindrical portion 128 which engages the inner surface of the conduit 20. This nozzle holder 126 is provided at the front end thereof with a notch, not shown, in which the flaring tabs 118 engage in the fixed closed position.

The said stem 24 is adapted to move lengthwise and is provided with a preferably frustoconical end 31 as a valve body which is adapted to engage the port 22 and seal it.

The stem is also provided with a shoulder 32 and a first spring 33 urging the said end 31 of the stem 24 against the port 22 is disposed between the shoulder 32 and the end of the inner cylindrical portion 28.

In the concave moulding 23 there is mounted a trigger 34 by means of a cylindrical shaft 35 having a diameter substantially equal to that of the arc forming the moulding contour. Said shaft extends between two wings 36 of the trigger, connected by the front portion 37. Said front portion is provided with a straight portion 38 which may engage the lower portion of the discharge conduit 20, so that the latter limits the possibility of pivoting of the trigger in one direction. On the other side of the cylindrical shaft 35, the trigger is provided with two arms 39, disposed forkwise and having a curved end surface 40.

The distance from the shaft 35 to the operative area of the front portion 37 is much greater than the distance from said shaft to the curved surface 40, whereby a force applied to said front portion is notably increased at said curved end surface. The trigger is mounted in the moulding 23 by pressing the shaft 35 against the moulding opening, whereby this yields resiliently and thereafter retains the trigger.

A tubular piston 41 is slidingly mounted in the cylinder 8 and is made of hard plastics material, such as polyamide, polypropylene or an acetal resin.

The longitudinal cavity 42 of the tubular piston 41 is extended by a dip tube 43 firmly attached to the piston and which communicates with the bottom of the receptacle (not shown). The piston is provided at the top end thereof with a front surface 44 which in the maximum insertion position of the piston in the cylinder bears against the upper inner surface 10 of the cylinder. Said piston is provided with a longitudinal annular groove 45 substantially coaxial with said cavity and both the groove and the cavity interrupt the said front surface. The piston 41 comprises a check valve 46, preferably formed by a ball 47 which may engage a valve seat 48 formed in the cavity 42. Discontinuous shoulders prevent the ball from coming out of the cavity 42. The valve 46 is located in an area close to the surface 44 such that the space between the ball and the mouth of the cavity is small.

Within the cylinder 8 there is also a second spring 50 between the upper inner surface 10 and the bottom of the groove 45. In the maximum insertion position of the piston, the spring is compressed wholly within the groove. The portion 51 of the piston adjacent the front surface 44 is substantially frustoconical, said portion partly confronting the passage 21 in the maximum insertion position of the piston. The provision of said frustoconical portion provides a small gap between the cylinder and the piston, aiding in the evacuation of the residual air and/or liquid in the maximum insertion position of the piston in the cylinder.

In the minimum insertion position of the piston, the free volume is formed by the volume of the pump chamber, plus the volume of the groove, that of the piston cavity to the valve 46, that of the frustoconical gap and that of the passage 21 up to the end 31 of the stem. Since these four last named volumes are relative small and are the only ones remaining free in the maximum insertion position of the piston, the ratio between the maximum and minimum cylinder volumes is at least 10:3 and therefore the pressure created in the pump chamber is at least 4.33 $kg/cm^2$ (about 62 $lbs/in^2$).

The first spring 33 is formed in such a way that a high pressure is required in the pump chamber 9 to overcome the force thereof, which pressure, when applied to the end 31 of the stem 24 lifts the said end from the port 22 and thereby opens the discharge conduit 20. When the sprayer is used for the first time and also whenever the pump chamber 9 contains substantially only air, to obtain the pressure required for opening the discharge conduit, it is practically necessary for the piston 41 to reach the upper inner surface 10 of the pump chamber. In this way, it is practically possible to expel all the air from the pump chamber on the first stroke of the piston, the chamber receives the fluid occupying the tube 43, at first air and then comprising only the liquid to be sprayed. In subsequent strokes of the piston, the valve 46 keeps the tube 43 full of said liquid.

When the pump chamber is thus full of liquid, a high pressure is also required in the pump chamber to open the discharge conduit. Therefore the liquid is forced out and the weak sprays or dripping at the beginning and the end of each pump stroke, as is usual with other sprayers, do not occur.

To seal the pump chamber, the tubular piston is provided on the outside thereof with a transverse groove 52 in which there is housed an O-ring 53 of a material which is more resilient and softer than that of the tubular piston. The material of the seal is Buna N, neoprene, polyvinyl chloride, copolymers, polythene and polypropylene in blends, nylon, viton, silicone, chloroprene or the like and is chosen appropriately in terms of the nature of the liquid to be sprayed.

The tubular piston 41 may not be formed from a material such as indicated for the O-ring, since it would be excessively soft.

Figure 2:
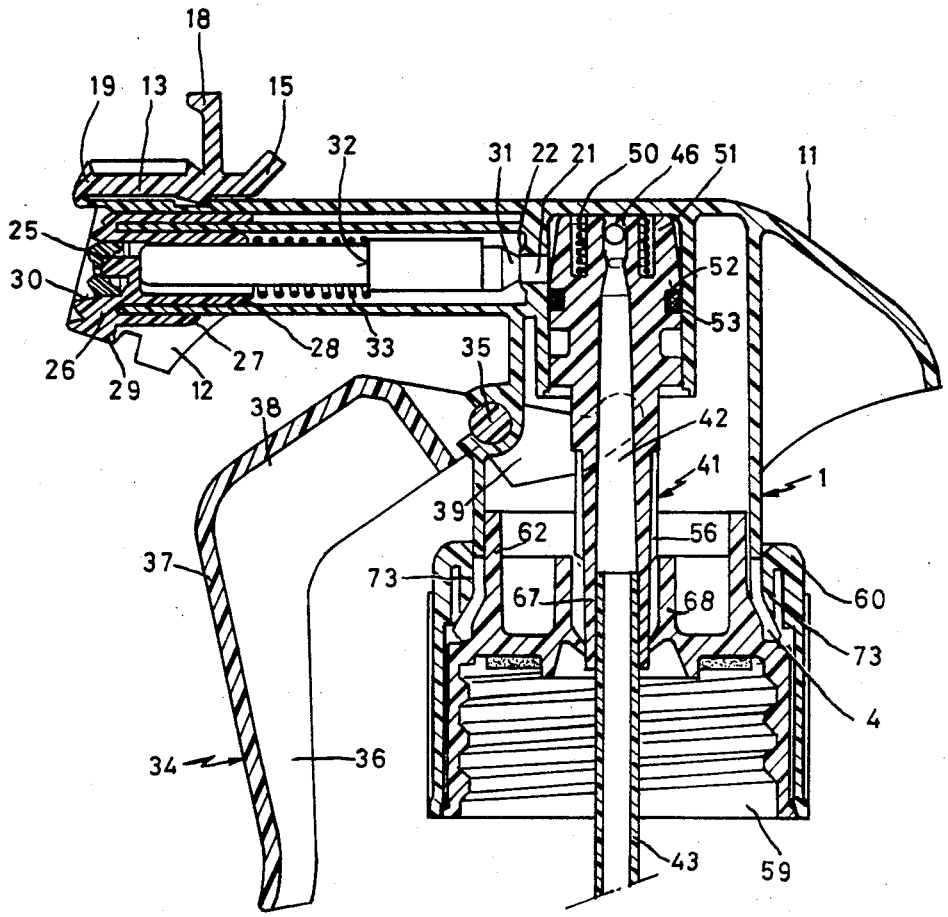
FIG. 2 is a similar view to FIG. 1, but showing the maximum insertion position of the piston in the cylinder, the cover being in the fixed open position.

The piston is also provided with a transverse annular shoulder, the lower surface 55 of which is engaged by the curved surface 40 of the forked arms 39 of the trigger 34. The operation of this arrangement of the trigger and piston is self-explanatory. One end position of the trigger is defined by the abutment action of the straight portion 38 of the trigger with the discharge conduit 20 (FIG. 1). The other end position is provided by the piston stroke itself (FIG. 2). Obviously the action of the spring 50 tends to urge the trigger into the FIG. 1 position.

Figure 3:
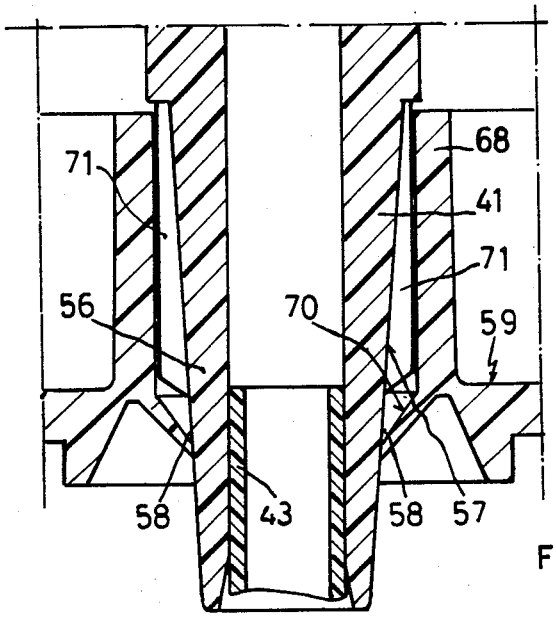
FIG. 3 is an enlarged axial cross section view of the end of the tubular piston opposite to the cylinder, shown engaging the inner surface of the axial space of the cap.
Figure 4:
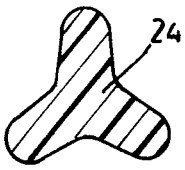
FIG. 4 is a cross section view of the stem.

From said shoulder 54, the piston extends to an end 56 (opposite to the cylinder 8) which is provided with a tapering external surface 57 (FIG. 3). Further reference will be made to these parts hereinafter.

Figure 7:
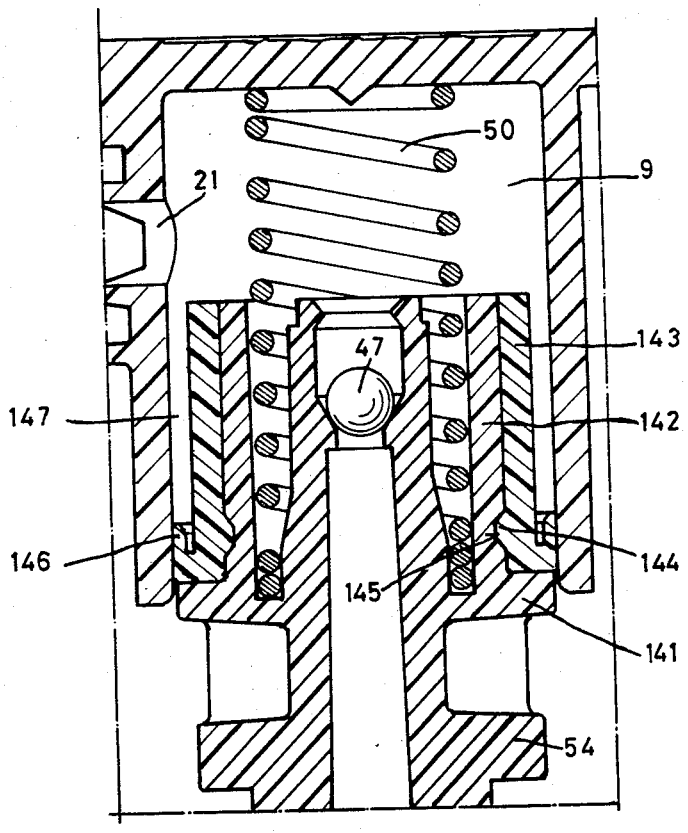
FIG. 7 is an axial section view, on a larger scale, of an alternative embodiment of the piston.

FIG. 7 illustrates a further embodiment of the piston. In this case, the piston 141 is provided with a section 142 of smaller diameter than the cylinder diameter and said section 142 is covered by a jacket 143 of a resilient material similar to the material contemplated for the O-ring joint 53. The jacket 143 is attached to the piston section 142 by means of the inwardly extending annular rib 144 of the jacket which engages in the corresponding annular groove 145 of the piston.

The jacket 143 is provided at the end thereof adjacent the receptacle with an outwardly directed appendix generally parallel to the jacket, folded over in 180°. The outer surface of the appendix snugly engages the cylinder so that said appendix forms a sealing member. Between the upper portion of the jacket and the cylinder in FIG. 7 there is a gap 147 facing the passage 21 in the maximum insertion position of the piston 141 in the cylinder. The purpose of this gap is equivalent to the gap formed by the tapering section 51 of the previously described embodiment.

Figure 5:
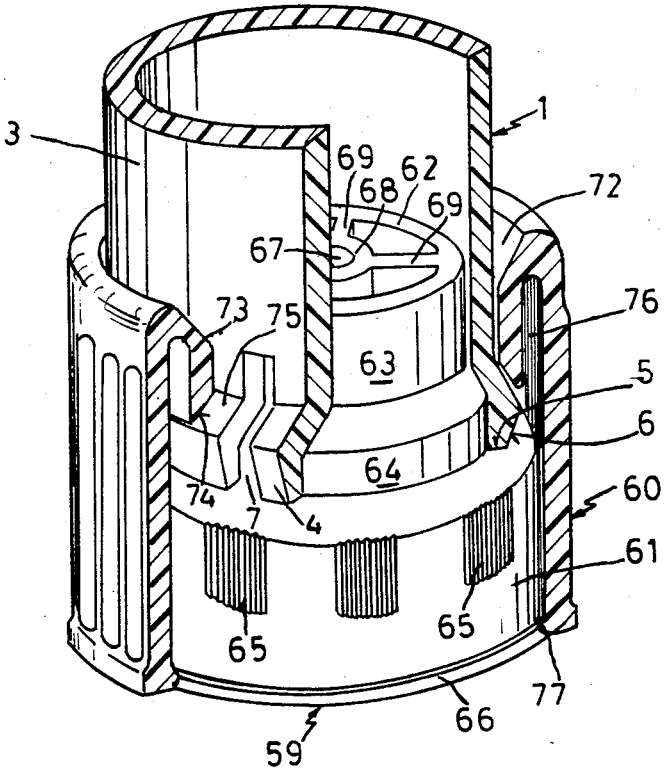
FIG. 5 is a perspective view on a larger scale and partly in section of the lower portion of the sprayer body, of the cap and of the cap sheath.

The sprayer is provided with means for the attachment thereof to the receptacle containing the liquid to be sprayed. Such means comprises an internally threaded screw cap 59 and a cap sheath 60 which cooperates with the lower part 3 of the sprayer body 1 (FIG. 5).

Above the internally threaded region 61 thereof, the screw cap 59 is provided with an axially extending tubular portion 62 the outer lateral surface 63 of which is substantially juxtaposed to the inner surface of said lower part 3. Preferably the portion 64 of the portion 62 closer to the internally threaded region 61 has a larger diameter and in such case said lower part 3 also has a larger diameter. The internally threaded region 61 is provided with discontinuous portions provided with axially extending knurlings 65. At the lower end of the screw cap there is at least one annular groove 66 and although only one is shown, there may be more than one groove.

Coaxially disposed with the portion 62 and with the screw cap there is an axially extending bore 67, the circular wall 68 of which is connected by radially extending walls 69 to the portion 62, making it more rigid. Said bore (FIG. 3) guides the piston 41 by means of the tabs 71 thereof and is provided with a tapering surface 70 having a different angle than that of the surface 57 of the lower end 56 of the piston. When the piston is at rest, the end 56 thereof bears with its tapered surface 57 on the surface 70 of the bore 67 and therefore seals the receptacle from the outside environment.

The sheath 60 of the screw cap 59 laterally covers said screw cap and said lower part 3 of the sprayer body 1 and is provided with an upper orifice 72 having a smaller diameter than that of the external tapered surface 6 of the portion 4 of said lower part 3. Said orifice 72 is also tapered. The sheath 60 and the body 1 are assembled together before assembling the screw cap by facing the tapered orifice 72 with the tapered surface 6. The smaller diameter of the orifice causes the lower part 3 of the body 1 to yield resiliently radially inwardly at the portion thereof containing the slits 7 until said portion has moved beyond the rolled over portion 73 of the sheath 60, at which time said portion recovers the original diameter thereof and stabilises the relative position of the body 1 and the sheath 60, with the free edge 74 of the rolled over portion bearing against a surface 75 of the larger outside diameter portion 64 of the portion 62 of the screw cap 59.

The sheath 60 is provided in the interior surface thereof with knurlings 76 which engage the knurlings 65 of the screw cap to ensure the relative position of both, particularly in the transverse direction. Furthermore, the sheath is provided with as many internal projections 77 as there are grooves 66 and they are of mating shape with the grooves 66, the mutual engagement thereof ensuring the relative positions of the sheath and the screw cap in an axial direction. The sheath and the cap may also be joined together by ultrasonic welding; in this case the knurlings 65 and 76 and ribs 77 and grooves 66 are not required.

The operation of the spray has been described in part in the previous paragraphs. Nevertheless, a succinct description of the operation thereof is given below. The assembly of the different parts of the sprayer has already been described. Starting out from the position of FIG. 1, with the sprayer coupled to a receptacle, in the first place the cover 13 is lifted by taking hold of the neb 15 and snapping the cover into the position of FIG. 2. The trigger 34 is pressed to cause the piston 41 to penetrate in the cylinder 8 against the force of the spring 50. During the upward stroke of the piston, the pressure in the pump chamber 9 rises, whereby the check valve 46 remains closed and therefore there is no communication between the pump chamber and the receptacle interior. When the air in said chamber reaches sufficient pressure to overcome the force of the first spring 33, the stem 24 is moved and the air in the chamber 9 flows through the passage 21 and discharge conduit 20 and out to the atmosphere through the nozzle 25, almost all the air being expelled from the chamber. When the trigger is released, the second spring causes the piston to move down, creating a depression in the chamber 9 which, on the one hand closes the valve formed by the end 31 of the stem and the port 22 of passage 21 and furthermore opens the check valve 46, by separating the ball 47 from the valve seat 48. During the downward stroke of the piston 41, the liquid contained in the container rises up the dip tube 43 and fills the pump chamber 9, until at the end of the downward stroke, the sprayer is ready for the first liquid spray. This spray is achieved by pressing the trigger 34 again and, as stated above, the spray is not produced until there has been obtained in the pump chamber 9 a pressure high enough to overcome the first spring 33, whereby the spray starts under a high pressure and is sharply cut off in case of a fall in said pressure, thereby avoiding dripping and short sprays.

What I claim is:

1. A liquid sprayer of the type comprising:

(a) a body having therein a cylinder defining a pump chamber, a discharge conduit and a passage between said chamber and said conduit, with a port forming a valve seat in the conduit side of said passage;

(b) a stem housed in said discharge conduit having an end forming a valve body capable of sealingly engaging said port;

(c) a first spring urging said stem in engagement with said port;

(d) a tubular piston extended by a dip tube, capable of sliding in said cylinder between a minimum insertion position and a maximum insertion position and having a check valve controlling the communication between said dip tube and said pump chamber;

(e) a second spring urging said piston to the minimum insertion position thereof in said cylinder;

(f) a rocking trigger adapted to cause the sliding movement of said piston;

(g) means for mounting said trigger to said body; and (h) means for attaching the sprayer to a receptacle containing liquid to be sprayed; and wherein said piston is provided with a planar front surface which in the maximum insertion position of the piston engages the upper inner surface of said cylinder, said planar front surface being interrupted by an opening leading to a cavity of the tubular piston and by a longitudinal annular groove generally coaxial with the piston and whose radial inner and outer walls surround the whole of said second spring in the maximum compression position thereof.

2. The liquid sprayer of claim 1, wherein said check valve is located in the cavity of said piston in a region adjacent said front surface.

3. The liquid sprayer of claim 1, wherein the portion of the piston side wall closest to the front surface of the piston is generally frustoconical, said frustoconical portion partly confronting said passage in the maximum insertion portion of the piston.

4. The liquid sprayer of claim 1, wherein one portion of the piston is of smaller diameter than the diameter of the cylinder and said portion is covered by a jacket of resilient material, one of the ends thereof being provided with an appendix which extends outwardly, the outer surface of said appendix snugly engaging the cylinder wall forming a sealing member, there being a gap between part of the jacket and the cylinder, said gap confronting said passage in the minimum cylinder volume position of said piston.

5. The liquid sprayer of claim 1, in which the lower part of said body opposite said cylinder is generally cylindrical and in which the attachment means to the liquid containing receptacle comprises an internally threaded screw cap, wherein said screw cap has an axially extending annular portion the outer side surface of which is generally juxtaposed the inner surface of said lower part, this latter having a portion adjacent the edge thereof which is externally frustoconical with an increasing diameter from said edge, said lower part having longitudinal slits providing radial resilience and wherein there is a screw cap sheath covering the sides of said screw cap and said lower part, said sheath having an upper orifice of a diameter smaller than that of the frustoconical portion, said orifice having a frustoconical shape.

6. The liquid sprayer of claim 5, wherein said screw surface of said sheath or the outer side surface of said screw cap is provided with axially extending knurlings.

7. The liquid sprayer of claim 5, wherein said screw cap sheath is provided in the inside of the lower end thereof with means for retaining said screw cap.

8. The liquid sprayer of claim 5, wherein said screw cap sheath and said screw cap are connected together at their respective ends adjacent the respective lower openings thereof by ultrasonic welding.

9. The liquid sprayer of claim 5, wherein said tubular piston is provided in the end thereof opposite said cylinder with an outer frustoconical surface, said screw cap being provided with an axial bore snugly guiding the piston, said bore having a frustoconical surface with which the frustoconical portion of the piston engages.

10. A liquid sprayer of the type comprising:

(a) a body having therein a cylinder defining pump chamber, a discharge conduit and a passage between said chamber and said conduit, with a port forming a valve seat in the conduit side of said passage;

(b) a stem housed in said discharge conduit having an end forming a valve body capable of sealingly engaging said port;

(c) a first spring urging said stem in engagement with said port;

(d) a tubular piston extended by a dip tube, capable of sliding in said cylinder between a minimum insertion position and a maximum insertion position and having a check valve controlling the communication between said dip tube and said pump chamber;

(e) a second spring urging said piston to the minimum insertion position thereof in said cylinder;

(f) a rocking trigger adapted to cause the sliding movement of said piston;

(g) means for mounting said trigger to said body;

(h) means for attaching the sprayer to a receptacle containing liquid to be sprayed, the lower part of said body opposite said cylinder being generally cylindrical and said sprayer attaching means including (i) an internally threaded screw cap, wherein said screw cap has an axially extending annular portion the outer side surface of which is generally juxtaposed to the inner surface of said lower body part, the lower body part having a portion adjacent the edge thereof which is externally frustoconical with an increasing diameter from said edge and having longitudinal slits in said frustoconical position providing radial resilience thereto, and (ii) a screw cap sheath covering the sides of said screw cap and said lower body part, said sheath having an upper orifice of a diameter smaller than that of said frustoconical portion, said orifice having a frustoconical shape; and wherein in the minimum insertion position of the piston in the cylinder, the free volume of the pump chamber and said passage formed between said check valve and the valve formed by said stem and said port is at least 3.33 times greater than the free volume in the maximum insertion position of the piston in the cylinder.

11. The liquid sprayer of claim 10, wherein the inner surface of said sheath or the outer side surface of said screw cap is provided with axially extending knurlings.

12. The liquid sprayer of claim 10, wherein said screw cap sheath is provided in the inside of the lower end thereof with means for retaining said screw cap.

13. The liquid sprayer of claim 10, wherein said screw cap sheath and said screw cap are connected together at their respective ends adjacent the respective lower openings thereof by ultrasonic welding.

14. The liquid sprayer of claim 10, wherein said tubular piston is provided in the end thereof opposite said cylinder with an outer frustoconical surface, said screw cap being provided with an axial bore snugly guiding the piston, said bore having a frustoconical surface with which the frustoconical portion of the piston engages.

* * * * *